US006965287B2

(12) United States Patent
Mitrovic

(10) Patent No.: US 6,965,287 B2
(45) Date of Patent: Nov. 15, 2005

(54) LOW REFLECTION MICROWAVE WINDOW

(75) Inventor: Andrej S. Mitrovic, Phoenix, AZ (US)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 10/813,075

(22) Filed: Mar. 31, 2004

(65) Prior Publication Data

US 2005/0219015 A1 Oct. 6, 2005

(51) Int. Cl.[7] ..... H01P 1/08
(52) U.S. Cl. ..... 333/252; 118/723 MW; 156/345.42
(58) Field of Search ..... 333/252; 118/723 MW, 118/723 MR, 723 MA; 156/345.42; 315/111.21

(56) References Cited

U.S. PATENT DOCUMENTS 5,038,712 A 8/1991 Fujiyama
5,234,526 A 8/1993 Chen et al.
5,389,154 A 2/1995 Hiroshi et al.
5,455,085 A 10/1995 Miller
5,587,039 A 12/1996 Salimian et al.
5,600,290 A 2/1997 Anderson, II
6,087,614 A * 7/2000 Ishizuka et al. ..... 219/121.43
6,200,651 B1 * 3/2001 Roche et al. ..... 427/571
2003/0213800 A1 11/2003 Williamson et al.

OTHER PUBLICATIONS

"Definition of Wave Impedance," Telecom Glossary 2K, Atis Organization, 1 page page.
Weisstein, Eric, "Wave Impedance," World of Physics, Scienceworld.wolfram.com/physics/WaveImpedance.html, 2 pages.

* cited by examiner

*Primary Examiner*—Seungsook Ham
(74) *Attorney, Agent, or Firm*—Pillsbury Winthrop Shaw Pittman LLP

(57) ABSTRACT

A microwave window for transmitting microwave radiation includes a solid body and a flange. The solid body includes a first surface and a second surface spaced apart from each other in a first direction thereby defining a thickness of the solid body in the first direction. The flange is disposed at a periphery of the solid body such that a peripheral portion of the solid body extends a length into the flange in a second direction perpendicular to the first direction. The thickness and the length are selected such that the power of reflections of microwave radiation by the microwave window are no more than about ten times the power of reflections at the minimum value.

47 Claims, 5 Drawing Sheets

LOW REFLECTION MICROWAVE WINDOW

FIELD OF THE INVENTION

The present invention pertains to microwave systems in general and in particular to a low reflection microwave window and to a method for minimizing microwave reflection in a microwave window.

BACKGROUND OF THE INVENTION

Microwave systems such as microwave waveguide systems and microwave plasma processing systems may use windows to isolate parts of the systems. In plasma processing systems, microwave energy can be used, for example, to create a plasma such as in Electron Cyclotron Resonance (ECR) systems, to pump process gases such as in a plasma pump and/or to allow access to microwave plasma diagnostics. In these plasma processing systems microwave windows are used to separate a processing chamber, which can be under high vacuum, from an incoming microwave waveguide, which can be at atmospheric pressure.

In plasma processing systems, the microwave window is installed on a wall of the process chamber at the place where microwave energy is delivered to the process chamber. The microwave window is usually made of ceramic dielectric materials, such as alumina ($Al_2O_3$), aluminum nitride (AIN) and PTFE (Teflon).

BRIEF SUMMARY OF THE INVENTION

An aspect of the present invention is to provide a microwave window for transmitting microwave radiation. The microwave window includes a solid body and a flange. The solid body includes a first surface and a second surface spaced apart from each other in a first direction thereby defining a thickness of the solid body in the first direction. The flange is disposed at a periphery of the solid body such that a peripheral portion of the solid body extends a length into the flange in a second direction perpendicular to the first direction. The thickness and the length are selected such that the power of reflections of microwave radiation by the microwave window are no more than about ten times the power of reflections at the minimum value.

Another aspect of the invention is to provide a method for optimizing dimensions of a window for minimizing reflections of microwave radiation by the window. The window includes a solid body and a flange. The solid body includes a first surface and a second surface spaced apart from each other in a first direction thereby defining a thickness of the solid body in the first direction. The flange is disposed at a periphery of the solid body such that a peripheral portion of the solid body extends a first length into the flange in a first direction and extends a second length in a second direction perpendicular to the first direction. The window is mounted on a wall of a chamber housing a plasma. The method includes running microwave simulations of microwave radiation transmission at various thicknesses of the solid body by taking into account absorption effects of the plasma and determining the thickness of the solid body at which the power of reflections of the microwave radiation at a desired microwave frequency in the window are no more than about ten times the power of reflections at the minimum value.

BRIEF DESCRIPTION OF THE DRAWINGS

A detailed description of the invention is given below with reference to the accompanying drawings, of which.

DETAILED DESCRIPTION OF EMBODIMENTS OF THE INVENTION

Figure 1:
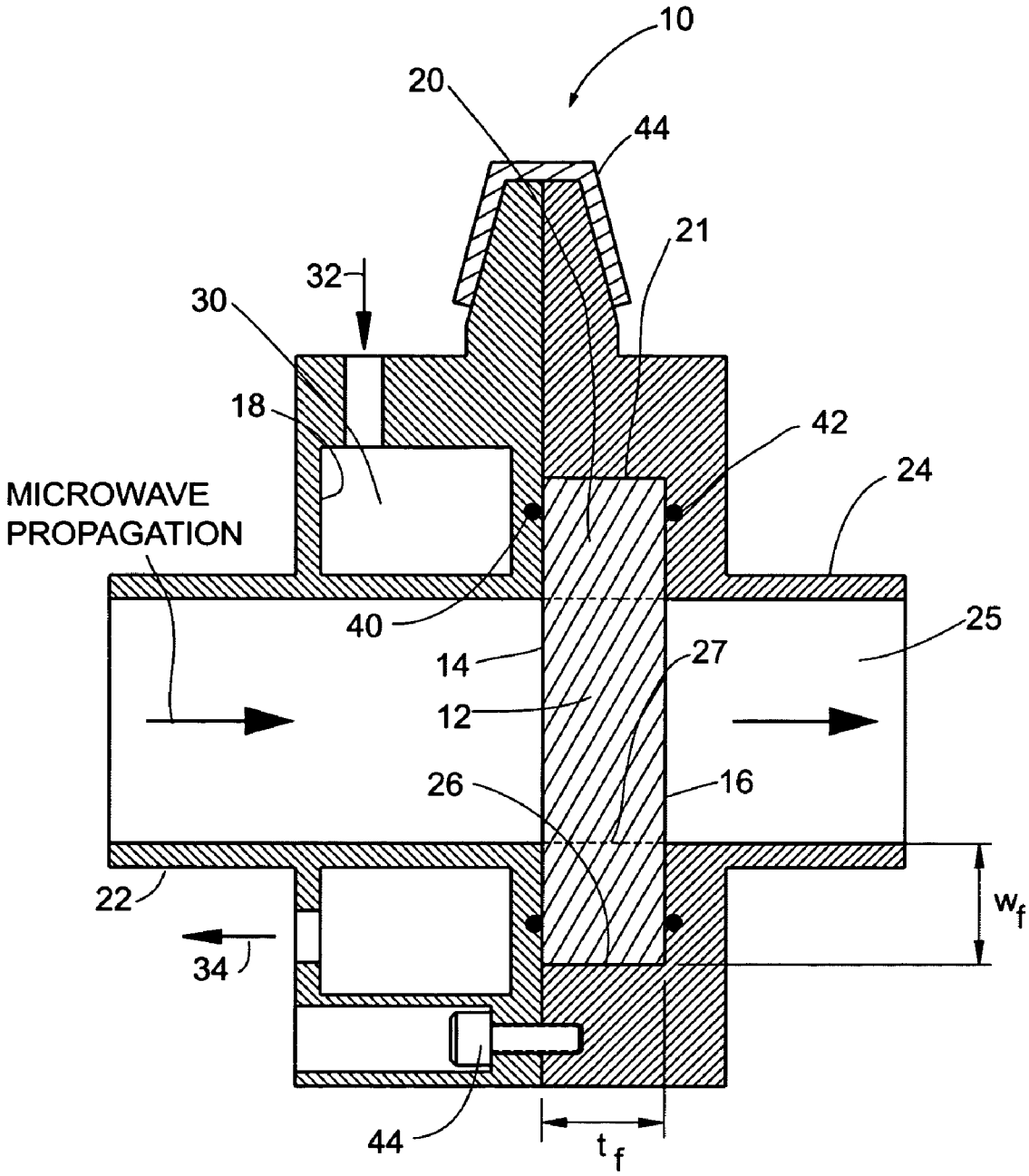
FIG. 1 is a cross-section view of a microwave window according to an embodiment of the invention.

FIG. 1 shows a microwave window 10 for transmitting microwave radiation according to an embodiment of the invention. The microwave window 10 comprises a solid body 12. The solid body 12 includes a first surface 14 and a second surface 16 spaced apart from each other in a first direction thereby defining a thickness tf of the solid body of material 12 in the first direction. The first direction corresponds to the direction of propagation of microwave radiation (indicated in FIG. 1 by arrows) or to the direction opposite that of propagation of microwave radiation (e.g. the opposite direction to the arrows).

The microwave window 10 also comprises a flange 18. The flange 18 is disposed at a periphery of solid body 12 such that a peripheral portion 20 of the solid body 12 extends a length wf into the flange 18 and/or structure 24, in a second direction perpendicular to the first direction. The flange 18 is used to mount solid body 12 to a waveguide 22. The waveguide 22 can be integrally formed with the flange 18. The flange 18 is also used to clamp and/or seal the solid body 12 onto a structure 24, which may be another flange connected or integral with a microwave waveguide, or a plasma processing chamber, or any other device into which microwave energy is coupled. The waveguide 22 guides microwave radiation across solid body 12 into a volume 25 on the opposite side of solid body 12.

The solid body 12 can be used to isolate different parts of a system while allowing microwave radiation to be delivered to selected parts of the system. For example, one portion or portions of the microwave guide 22 on one side of solid body 12 may be pressurized or at ambient pressure while another portion, such as volume 25, on the other side of the solid body 12 may be under vacuum. In order to prevent gas from entering the portion under vacuum in the volume 25, the solid body 12 in conjunction with the flange 18 which includes a sealing member is used to isolate the portion under vacuum. In this way, the solid body 12 isolates the two portions while allowing microwave energy to propagate, for example, from microwave guide 22 to the portion under vacuum in volume 25.

Because a peripheral portion 20 of the solid body 12 extends a length wf into the flange 18 in a second direction perpendicular to the first direction, a cavity 21 is formed around portion 20 of solid body 12. The cavity 21 is delimited on one side by flange 18 and on the other side by structure 24. The cavity 21 has a dimension tf in the direction of propagation of microwave radiation. The dimension tf is defined by the thickness of solid body 12. The cavity 21 has a dimension wf in the direction perpendicular to the direction of propagation of microwave radiation. The dimension wf is defined by the extent in which the peripheral portion 20 of solid body 12 extends into the flange 18 and/or structure 24.

The cross-sectional dimensions of solid body 12, are larger than the cross-sectional dimensions of waveguide 22. However, when such a solid body 12 is mounted onto flange 18 or structure 24, the transmission of microwave radiation through solid body 12 is affected because a peripheral portion of solid body 12 is inserted into flange 18, or structure 24. This step change of waveguide dimensions leads to a change of the impedance characteristics of the waveguide which can result in the creation of a reflection point for microwave energy. Similarly, at a point where the waveguide cross- sectional dimensions revert to their old values (i.e. at surface 16), another reflection point is created.

In order to reduce reflections due the stepped waveguide around the cavity 21, the portion 20 of solid body 12 which extends into the flange 18 and/or structure 24 is configured with dimensions that allow minimizing possible reflections of microwave radiation.

Indeed, when microwave radiation traverses solid body 12, microwaves propagate into the cavity 21 formed by portion 20 of solid body 12. This may result in waves being potentially reflected off of walls delimiting the cavity 21. The walls forming the cavity 21 include walls of flange 18 and/or walls of structure 24. The reflection of microwave radiation inside cavity 21 or edges of cavity 21 can lead to the formation of standing waves. The standing waves can be formed, for example, when a reflected wave is sent backwards to a microwave power source. This may not only decrease efficiency of transmission of microwave radiation but may also lead to a more serious problem which has a potential for damaging the microwave source or some of its components (not shown). In addition, when a plasma takes place inside volume 25, microwave radiation emitted by the plasma, such as at harmonic frequencies of the microwave power source frequency, may be sent in a direction opposite that of the arrow in FIG. 1, toward solid body 12. A detector (not shown) can be disposed on the opposite side of solid body 12 at the end of waveguide 22, for example, to detect the harmonic microwave radiation emitted by the plasma, or radiation coupled to the plasma from an outside source through another similar window, such as is often the case with plasma microwave diagnostics. This detector can be used, for example, to monitor characteristics of the plasma inside volume 25. In this case also, reflections may occur inside cavity 21 or at edges of cavity 21 leading to potentially decreasing the intensity of microwave radiation reaching the detector. Attenuation of the microwave radiation reaching the detector can lead to a distorted measurement by the detector of the microwave radiation intensity.

In order to reduce reflections inside cavity 21, the dimensions of cavity 12 are selected such that the microwave radiation traversing the solid body 12 does not "see" cavity 21 along its path from waveguide 22 side to the other side of solid body 12 in volume 25. Specifically, the dimension tf of the cavity 21 in the direction of propagation of microwave radiation is selected to be equal to $n\lambda/2$ and the dimension wf in the direction perpendicular to the direction of propagation of microwave radiation is selected to be equal to $m\lambda/2$. The factors m and n are integer numbers and $\lambda$ is the wavelength of microwave radiation in solid body 12. The integer numbers n and m can be equal to or different from each other.

This can be understood by the fact that in radiofrequency physics, wave impedance at one point (first point) in a waveguide can be translated into the impedance at another point (second point) in the waveguide. If the first point and the second point are spaced apart by an integer number of half wavelengths of the radiofrequency energy, the impedance at the first point and the impedance at the second point are the same. For example, if the first point is taken at the surface 14 of solid body 12 and the second point is taken at the surface 16 of solid body 12, in order to obtain the same wave impedance at the first point and at the second point, the distance between the surfaces 14 and 16, i.e. the thickness tf of body of material 12, should be substantially equal to $n\lambda/2$. In this instance, the microwave radiation reaching the surface 14 would reach the surface 16, in theory, with the exact same wave impedance, and thus no power loss due to reflection. However, reflection losses inherent to a difference between the index of refraction of the medium inside waveguide 22 (e.g., air) and the index of refraction of the material of solid body 12 at a specific radiation wavelength may be unavoidable, but can be reduced at specific frequencies, as will be shown later.

Similarly, if a first point is taken at a wall 26 of cavity 21 and a second point is taken at a virtual wall 27, the virtual wall 27 corresponding to the continuation of a wall of waveguide 22 into the body of material 12, in order to obtain the same wave impedance at the first point and at the second point, the distance between the wall 26 and the virtual wall 27, i.e., the extent wf by which portion 20 of solid body of material 12 extends into flange 18 and/or structure 24, should be substantially equal to $m\lambda/2$. If the impedance at wall 26 and the impedance at virtual wall 27 are equal, the wave which travels in a direction perpendicular to the extent direction would "see" the virtual wall 27 as being a wall equivalent to wall 26. This is due to fact that the impedance at the wall 26 is equal to the impedance at the virtual wall 27 when the extent distance wf is equal $m\lambda/2$. As a result, the wave propagates through solid body 12 and traverses solid body 12 as if guided by virtual wall 27 without any significant influence of cavity 21. In other words, the virtual wall 27 makes the waveguide 22 act almost like there is no portion 20 of solid body 12 that extends into the flange 18 and/or structure 24. Consequently, any reflection that may occur due to the stepped design of flange 18 is significantly reduced.

The solid body 12 can be, for example, selected from dielectric materials such as, but not limited to, alumina and aluminum nitride. The solid body of material can also be made of quartz, silicon nitride or a fluoropolymer such as Polytetrafluoroethylene (PTFE). The selection of a particular material for solid body 12 would depend on the wavelength of microwave radiation used and also on the intended application of the microwave radiation. In general, the material of solid body 12 would be substantially transparent at the microwave radiation wavelength used. Furthermore, if the microwave radiation is used in a plasma process, the material of solid body 12 would be selected according to the chemistry of the plasma process, to provide high resistance to the plasma chemistry.

The wall of waveguide 22 and/or wall of structure 24 can be selected from a metal such as, aluminum alloy or steel. Similar to solid body 12, if the microwave radiation is used for generating a plasma in a plasma process, the material of structure 24 can be selected according to the chemistry of the plasma process.

The cross-section of solid body 12 can have any suitable shape such as a circular shape or polygonal shape. Similarly, waveguide 22 can have any suitable shape such as a circular shape or a polygonal shape.

The flange 18 comprises a fluid cavity 30. The fluid cavity 30 includes a fluid inlet 32 and a fluid outlet 34. A cooling fluid is input through the fluid inlet 32 and evacuated through fluid outlet 34. The fluid cavity 30 is filled with the cooling fluid in order to cool the solid body 12 and more generally the entire window assembly 10. This allows the solid body 12 and the entire window assembly 10 to be maintained in a desired temperature range. Indeed, in the case were the volume 25 is a volume defined by a plasma chamber housing a plasma process, the solid body 12 is subject to a heat flux generated by the plasma. In order, to prevent damage of the solid body 12 by the heat flux generated by the plasma, a cooling system comprising the fluid cavity 30 is provided. The cooling system can be integrated with the flange 18 in the manner described above or provided separate from the flange 18, for example, as a serpentine wound in a spiral around or in the vicinity of the solid body 12. The cooling channel 18 can also be embedded in structure 24, if dimensions of the structure allow.

Seals 40 and 42 are provided on each side of solid body 12 to seal the solid body 12 to the walls of the flange 18 and to the walls of structure 24, at the left and right sides of cavity 21. Although a pair of seals 40 and 42 are shown in FIG. 1, one can also use one seal and still maintain a vacuum- tight window. The seals 40 and 42 can be, for example, O-rings or flat gaskets. The materials of O-rings and flat gaskets can be selected depending on the materials of the structure 24 and flange 18 and depending on the heat load that the solid body 12 may be subject to. The seals also need to be compatible with the chemistry present in volume 25. The seal 42 seals the solid body 12 to the structure 24 and the seal 40 seals the solid body 12 to the flange 18.

The flange 18 is secured to the structure 24 by one or a plurality of attachment devices 44. Attachment device 44 can be any conventional attachment device such as a clamping ring, a bolt, screw, etc. Attachment devices 44 thus hold the solid body 12 against the walls of structure 24, and of flange 18.

Figure 2:
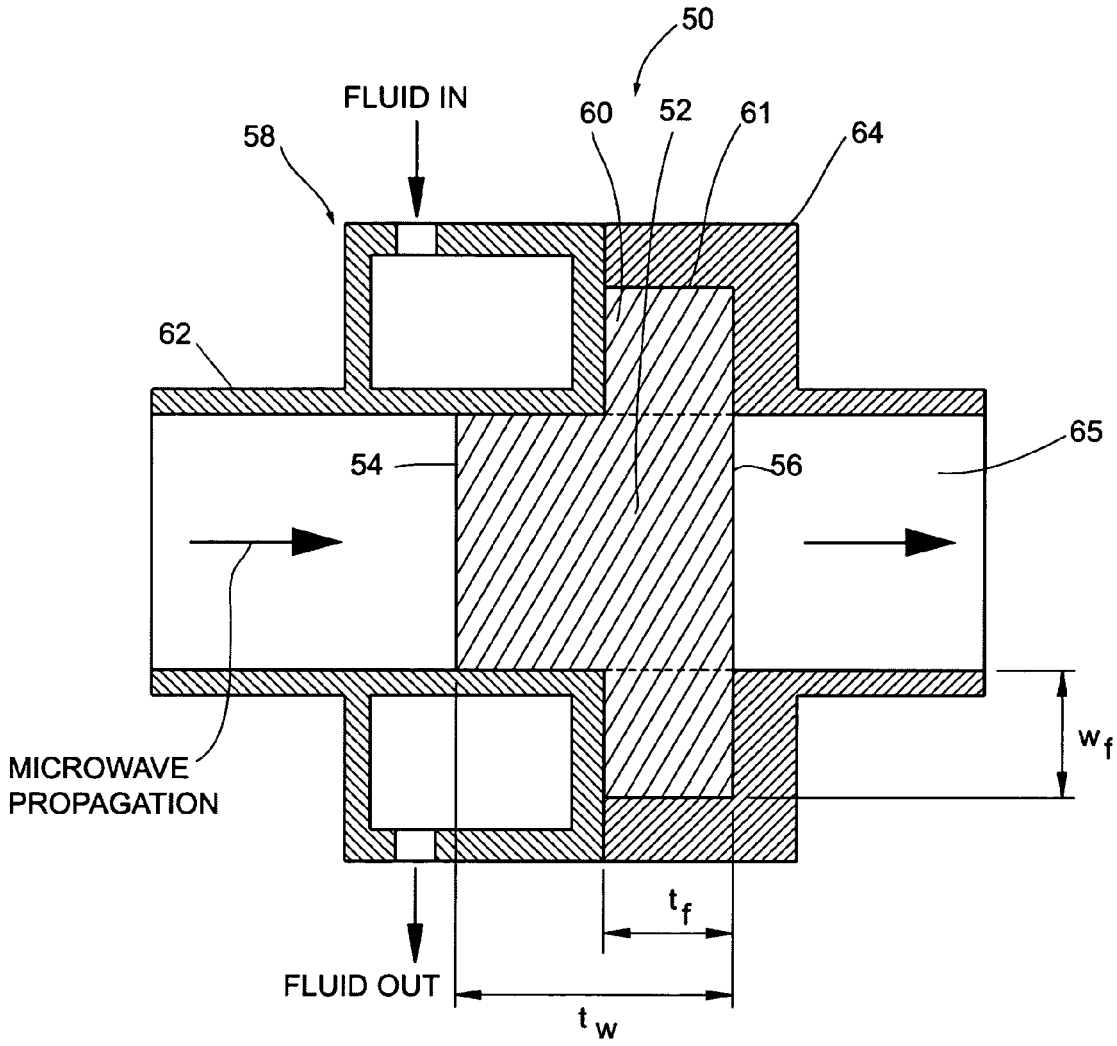
FIG. 2 is a cross-sectional view of a microwave window according to another embodiment of the invention.

Referring now to FIG. 2 which shows a microwave window 50 for transmitting microwave radiation according to another embodiment of the invention. Similar to the microwave window 10 described above, the microwave window 50 also comprises a solid body 52. The solid body 52 includes a first surface 54 and a second surface 56 spaced apart from each other in a first direction thereby defining a thickness tw of the solid body of material 52 in the first direction. The first direction corresponds to the direction of propagation of the microwave radiation. The direction of propagation of microwave radiation is indicated in FIG. 2 by an arrow. This is the case when, for example, a power source of microwave radiation is used to send radiation from one side of solid body 52 to an opposite side of solid body 52. Alternatively, the direction of propagation of microwave radiation can be opposite to the arrow as indicated in FIG. 2. In this latter case, a plasma plays the role of a microwave source on one side of solid body 52 and a detector can be disposed on an opposite side to monitor radiation emitted by the plasma. Similarly, the direction of propagation of microwave radiation is out of the plasma in microwave plasma diagnostic systems, where the microwave energy is coupled into the plasma through another similar window from an external microwave power source.

The microwave window of the embodiment shown in FIG. 2 also comprises a flange 58. The flange 58 and structure 64 are disposed at a periphery of the solid body of material 52 such that a peripheral portion 60 of the solid body 52 extends a length wf into the flange 58 and/or structure 64, in a second direction perpendicular to the first direction. The flange 58 is used to mount a waveguide 62 on one side of solid body material 52 to guide microwave radiation across solid body of material 52 into a volume 65 on the opposite side. The flange 58 is also used to clamp and/or seal the solid body 52 onto structure 64.

Similar to the embodiment shown in FIG. 1, the solid body 52 is used to isolate parts of a system while allowing microwave radiation to delivered between these isolated parts. For example, one portion or portions of the microwave guide 62 on one side of the solid body 52 may be pressurized while another portion, such as volume 65, on the other side of the solid body 52 may be under vacuum. In order to prevent gas from escaping from the pressurized portion of the microwave guide 62 to the portion under vacuum in the volume 54, the solid body 52 and flange 58 are used to isolate the pressurized portion from the portion under vacuum. In this way, the solid body 52 provides a way to isolate the two portions while allowing microwave energy to propagate, for example, from the pressurized portion or microwave guide 62 to the portion under vacuum in volume 64.

Because a peripheral portion 60 of the solid body 52 extends a length wf into the flange 18 and/or structure 64 in a second direction perpendicular to the first direction, a cavity 61 is formed around portion 60 of solid body 52. The cavity 61 is delimited on one side by flange 58 and on the other side by structure 64. The cavity 61 has a dimension tf in the direction of propagation of microwave radiation. The dimension tf is defined by the thickness of portion 60 of solid body 52. The cavity 61 has a dimension wf in the direction perpendicular to the direction of propagation of microwave radiation. The dimension wf is defined by the extent in which the peripheral portion 60 of solid body 12 extends into the flange 58 and/or structure 64.

Similar to the microwave window 10, reflections of the microwave radiation which may occur because of cavity 61 are minimized by selecting the dimensions tf and wf to be equal to an integer multiple of half-wavelengths of the microwave radiation. In this way, the microwave radiation which traverses the solid body 52 does not "see" the cavity 61 in its propagation path from waveguide 62 to volume 65.

However, when a plasma process takes place inside volume 25 of microwave window 10 or volume 65 of microwave window 50, the thickness of the solid body 12 or solid body 52 can be adjusted or selected to take into account the impedance of the plasma, the absorption of the microwave energy by the plasma, or to adjust to a different waveguide impedance on the side of structures 24 or 64, when their impedance is different from that of waveguides 22 or 62.

For example, in microwave window 10, the dimension of the solid body that is most amenable to variation in order to arrive at a design in which reflections are minimized, is the thickness tf. The thickness tf can be varied to correct for the presence of the plasma in volume 25 while the dimension wf in microwave window 10 can be kept constant and equal to an integer multiple of half of the wavelength of the microwave radiation. The thickness tf of solid body 12 in microwave window 10 can be modified by, for example, machining one of the surfaces 14 or 16. However, this may also require modifying the dimensions of walls of the structure 26 and/or flange 18 so that the portion 20 of solid body 12 can fit in the cavity 21 to provide a seal.

In order to allow for variation of the thickness of the solid body to minimize microwave reflections in the microwave window without varying any of the dimensions of the cavity 61, solid body 52 is constructed having a T-shape longitudinal-section. In this way, the periphery of solid body 52 can fit in the cavity 61. The dimensions tf and wf may be selected to be equal to an integer multiple of half of the wavelength of the microwave radiation while a dimension tw (thickness) of solid body 52 in the direction of propagation of the microwave radiation can be varied to take into account the presence of the plasma in volume 64, or a different waveguide impedance extending from structure 64. The dimension tw can be equal to an integer multiple of half of the wavelength of the microwave radiation. However, in the presence of a plasma, the dimension tw can be varied to take into account the impedance of the plasma, at some nominal plasma processing conditions. In this case, the dimension or thickness tw is typically not equal to an integer multiple of half of the wavelength of the microwave radiation.

In order to determine the dimension tw that optimizes the microwave window transmission properties by minimizing microwave reflections in a microwave window, a method comprising running a series of RF simulations is used. The RF simulations are run for microwave radiation transmission at various thicknesses of the solid body 54 in the microwave window 50 by taking into account effects of a plasma. Specifically, the simulations are run with a volume 65 being enclosed in a plasma chamber (not shown) and the plasma itself is simulated by a conductive block to take into account effects of electromagnetic wave absorption by the plasma. The simulations are run using software such as ANSYS, written by ANSYS Inc. of Canonsburg, PA. However, other software such as ANSOFT HFSS written by ANSOFT Corp. of Pittsburgh, Pa., or any other commercial or custom-developed electromagnetic simulation code may be used.

The method also includes determining the thickness of the solid body 54 at which reflections of the microwave radiation at a desired microwave frequency in the window are minimum. In this respect, results of the simulations are recorded and plotted as various curves of reflection versus microwave frequency at various dimensions or thicknesses tw. In this way, the thickness tw which exhibits a minimum reflection at the desired microwave wavelength can be determined.

Figure 3:
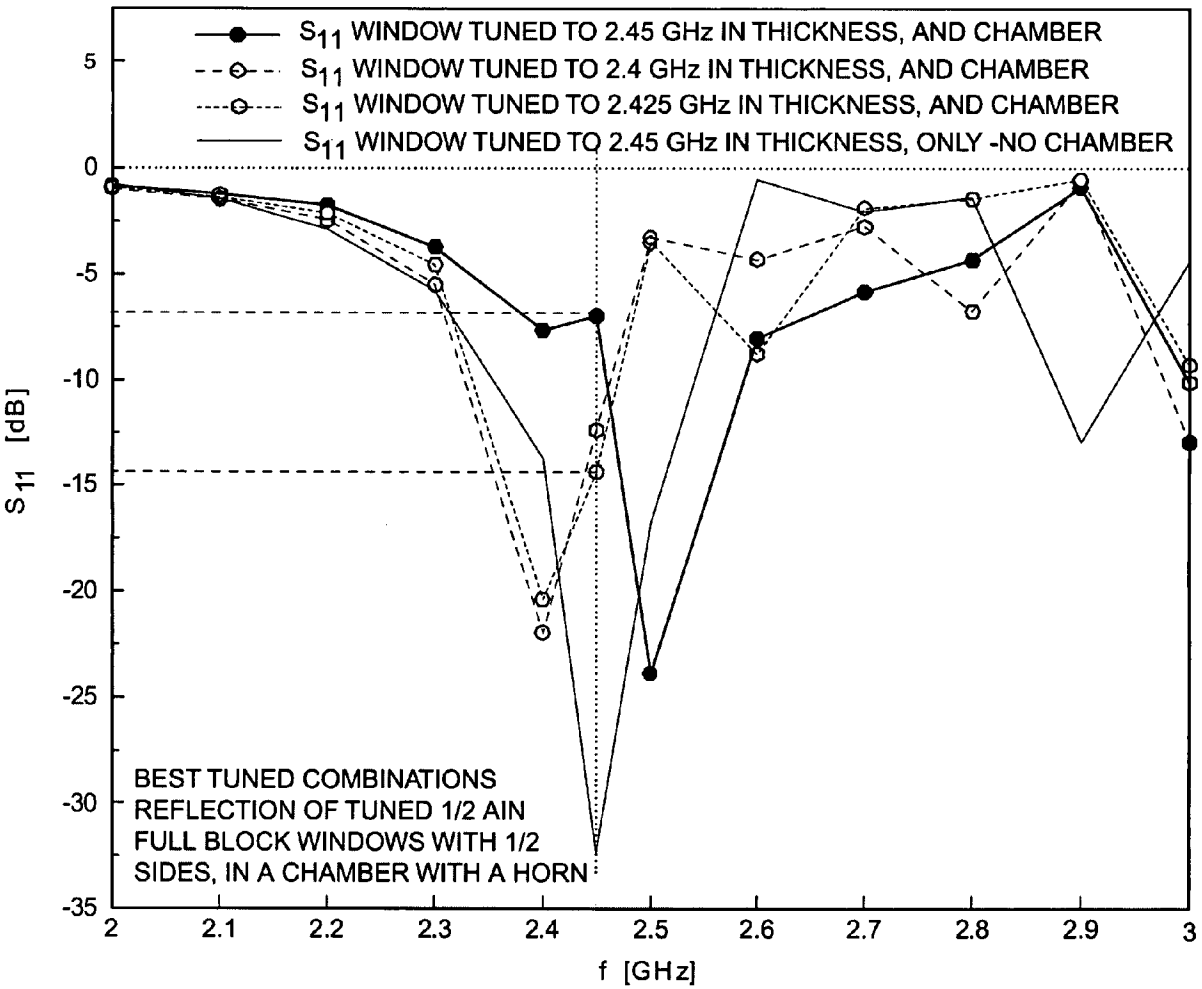
FIG. 3 is a graph of a series of curves of reflection of microwave radiation versus frequency of the microwave for various thicknesses of a microwave window.

FIG. 3 shows a series of curves of microwave reflection versus microwave frequency plotted at various thicknesses tw. One can see that a slight variation in thickness tw (which is expressed in this graph in terms of half wavelengths) results in a shift in the reflection minimum (expressed in dB). For example, the solid line curve is plotted in the case of a waveguide with a window and with no chamber (i.e. an identical waveguide is extending from structures 24 or 64). This curve shows that a microwave window having a thickness of a half wavelength in the material of body 52, at 2.45 GHz, presents a reflection minimum exactly at that frequency, i.e. 2.45 GHz. However, in the presence of a plasma and a plasma chamber of a geometry different than the incoming waveguides 22 or 62, the window which has a thickness equal to a half wavelength in body 52, of microwave energy at a frequency of 2.425 GHz, has a lower reflection (−14 dB) than a window with a thickness of a half wavelength in body 52, of microwave energy at a frequency of 2.45 GHz (−7 dB) with microwave energy having a frequency of 2.45 GHz. Furthermore, a window which has a thickness equal to a half wavelength in body 52 of energy at a frequency of 2.45 GHz shows a minimum reflection at a microwave wavelength of approximately 2.5 GHz, the shift being due to the presence of the plasma. As can be seen in FIG. 3, when the window dimensions are selected to produce reflections having a power no more than about ten times the minimum value, a significant reduction in reflections can be achieved. Alternatively, the window dimensions can be selected to produce reflections having a power no more than about five times or no more than about double the minimum value.

Figure 4:
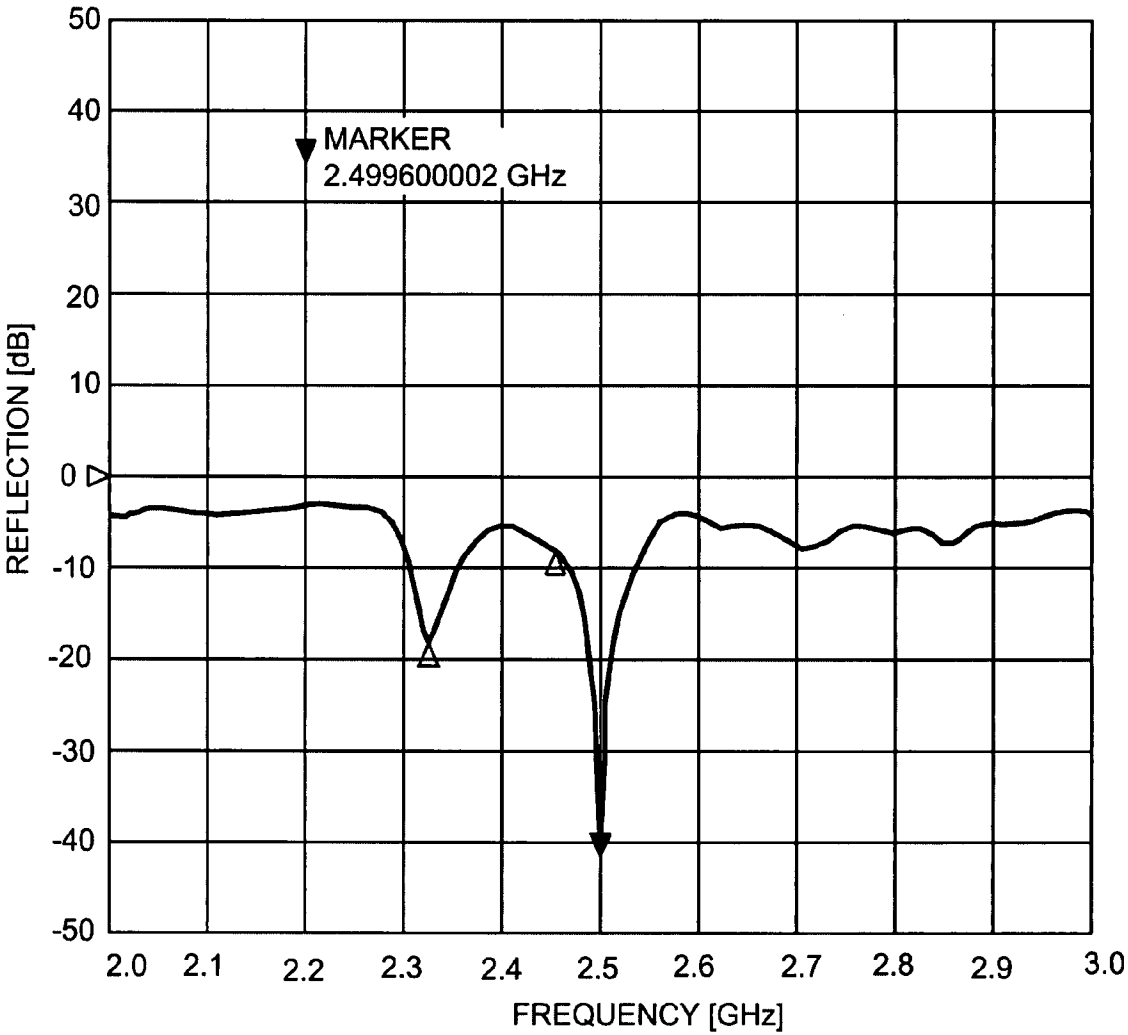
FIG. 4 is a graph of a measured reflection of microwave radiation versus the frequency of the microwave radiation exhibiting a minimum in the reflection.

FIG. 4 shows a graph of a measured reflection of microwave radiation versus the frequency of microwave radiation for an optimized window in accordance with the above simulation, but without the presence of the plasma. At a frequency of approximately 2.5 GHz, the curve shows a deep minimum reflection of approximately −40.9 dB. The shift of the measured minimum from 2.45 GHz (the design frequency) to 2.5 GHz is due to the lack of a plasma during the measurement. With a plasma present, the combination of the window, structure, and the plasma operate such that the reflection is minimized at the design frequency of 2.45 GHz. This demonstrates the effectiveness of the above described simulation method used in window design.

Figure 5:
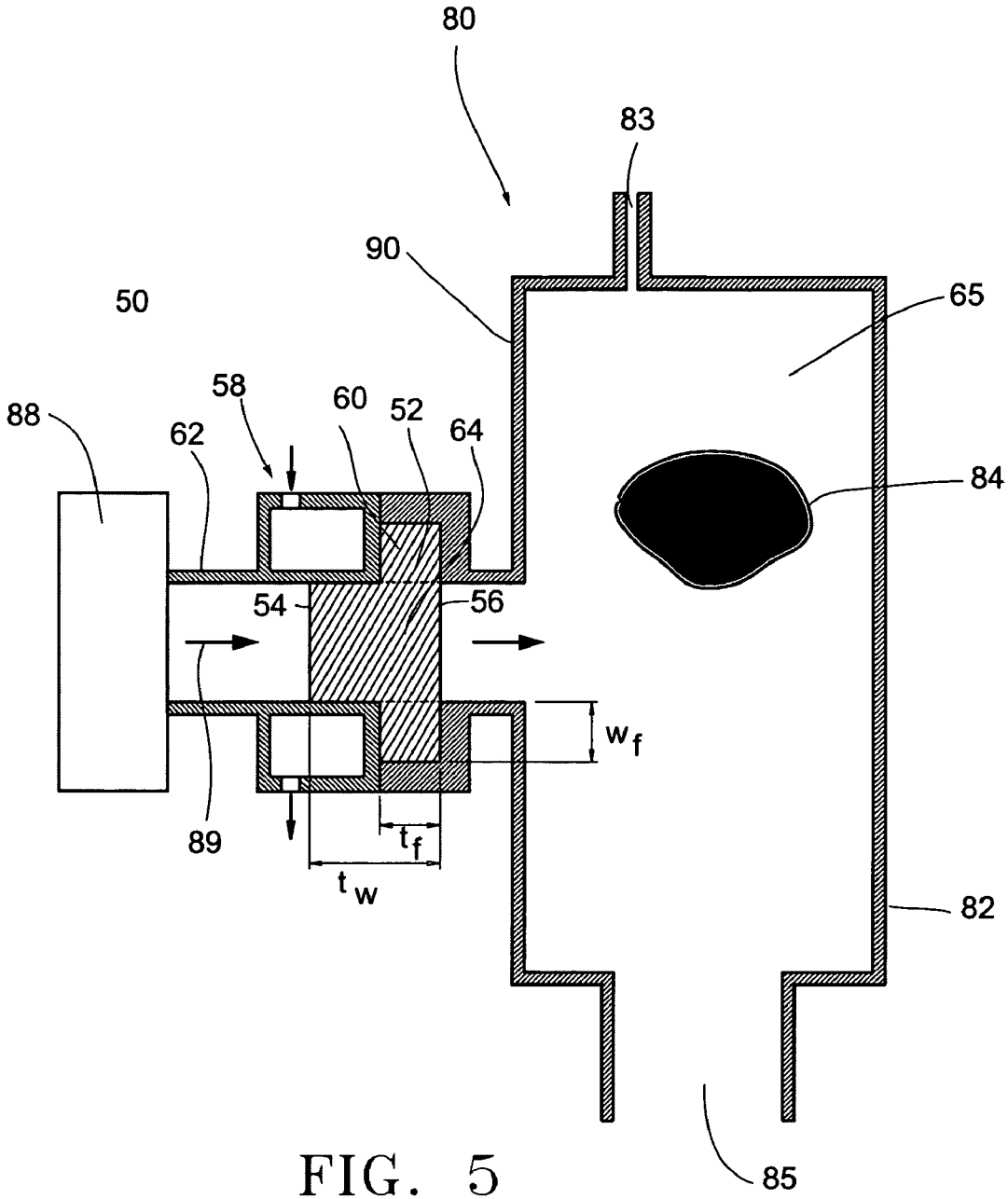
FIG. 5 is a cross-section of a plasma reactor including a microwave window according to yet another embodiment of the invention.

FIG. 5 shows a plasma reactor including a microwave window according to yet another embodiment of the invention. The plasma reactor 80 comprises a process chamber 82 adapted to house a plasma 84 in volume 65. A gas inlet 83 is adapted to introduce gas into chamber 82. Excess gas is evacuated via pump port 85. The plasma reactor comprises also a microwave source 88 adapted to emit microwave radiation 89. The plasma reactor further comprises microwave window assembly 50 mounted on wall 90 of process chamber 82. The microwave window 50 may comprise the elements described above in relation to FIG. 2. Alternatively, the microwave window 10 of FIG. 1 may be employed.

Although the above microwave window is described in relation to its application in a plasma process, one of ordinary skill in the art would appreciate that, for example, the above window can be used in microwave waveguides in general or in a microwave cavity such as in a maser, for example. Similarly, although the microwave window is described having certain forms and geometrical shapes other geometrical forms are also within the scope of the present invention. The many features and advantages of the present invention are apparent from the detailed specification and thus, it is intended by the appended claims to cover all such features and advantages of the described apparatus which follow the true spirit and scope of the invention.

Furthermore, since numerous modifications and changes will readily occur to those of skill in the art, it is not desired to limit the invention to the exact construction and operation described herein. Moreover, the process and apparatus of the present invention, like related apparatus and processes used in the microwave technology tend to be complex in nature and are often best practiced by empirically determining the appropriate values of the operating parameters or by conducting computer simulations to arrive at a best design for a given application. Accordingly, all suitable modifications and equivalents should be considered as falling within the spirit and scope of the invention.

What is claimed is:

1. A microwave window for transmitting microwave radiation comprising:

a solid body, the solid body including a first surface and a second surface spaced apart from each other in a first direction thereby defining a thickness of said solid body in said first direction;

a flange disposed at a periphery of said solid body such that a peripheral portion of the solid body extends a length into said flange in a second direction perpendicular to said first direction, wherein said thickness and said length are selected such that the power of reflections of microwave radiation by said microwave window are no more than about ten times the power of reflections at the minimum value.

2. A microwave window as recited in claim 1, wherein said thickness is equal to n $\lambda/2$, where n is an integer number and $\lambda$ is a wavelength of the microwave radiation.

3. A microwave window as recited in claim 1, wherein said length is equal to m $\lambda/2$, where m is an integer number and $\lambda$ is a wavelength of the microwave radiation.

4. A microwave window as recited in claim 1, wherein said flange is adapted to mount said solid body onto a structure.

5. A microwave window as recited in claim 4, wherein said structure is a wall of a microwave waveguide.

6. A microwave window as recited in claim 4, wherein said structure is a wall of a process chamber.

7. A microwave window as recited in claim 1, wherein said solid body comprises a dielectric material.

8. A microwave window as recited in claim 7, wherein said dielectric material is selected from one or both of the group consisting of alumina and aluminum nitride.

9. A microwave window as recited in claim 1, wherein said solid body comprises quartz.

10. A microwave window as recited in claim 1, wherein said solid body comprises silicon nitride.

11. A microwave window as recited in claim 1, wherein said solid body comprises a fluoropolymer.

12. A microwave window as recited in claim 1, wherein said solid body isolates parts of said microwave window held at different pressures.

13. A microwave window as recited in claim 1, wherein said solid body is substantially transparent at the wavelength $\lambda$ of the microwave radiation.

14. A microwave window as recited in claim 1, wherein said first direction is a direction of propagation of said microwave radiation.

15. A microwave window as recited in claim 1, wherein said peripheral portion of said solid body extending into said flange is surrounded by a cavity defined at least in part by said flange.

16. A microwave window as recited in claim 15, wherein said cavity has a first dimension in the first direction and a second dimension in the second direction.

17. A microwave window as recited in claim 16, wherein said first dimension and said second dimension are selected such that reflections of microwave radiation traversing said solid body are substantially minimized.

18. A microwave window as recited in claim 17, wherein said first dimension is equal to n $\lambda/2$ and said second dimension is equal to m $\lambda/2$, where n and m are integer numbers and $\lambda$ is the wavelength of the microwave radiation.

19. A microwave window as recited in claim 1, wherein said flange comprises a fluid cavity.

20. A microwave window as recited in claim 19, wherein said fluid cavity includes an inlet and an outlet.

21. A microwave window as recited in claim 20, wherein a fluid is input through said inlet and exits through said outlet.

22. A microwave window as recited in claim 21, wherein said fluid maintains said solid body in a desired range of temperatures.

23. A microwave window as recited in claim 4, wherein said flange mounts a microwave waveguide onto said structure.

24. A microwave window as recited in claim 23, wherein said waveguide is integrally formed with said flange.

25. A microwave window as recited in claim 4, further comprising one or more attachment devices to secure said flange to said structure.

26. A microwave window as recited in claim 25, wherein said attachment devices are bolts or screws.

27. A microwave window as recited in claim 25, wherein said attachment device is a clamp ring.

28. A microwave window as recited in claim 4, wherein said flange comprises a first seal member configured to seal said solid body to said structure and a second seal member configured to seal said solid body to said flange.

29. A microwave window as recited in claim 28, wherein at least one of said first seal member and said second seal member is an O-ring.

30. A microwave window as recited in claim 28, wherein at least one of said first seal member and said second seal member is a flat gasket.

31. A microwave window as recited in claim 1, wherein said solid body has a circular cross-section.

32. A microwave window as recited in claim 1, wherein said solid body has a polygonal cross-section.

33. A microwave window as recited in claim 1, wherein the power of the reflections of microwave radiation by said microwave window are not more than about five times the power of reflections at the minimum value.

34. A microwave window as recited in claim 1, wherein the power of the reflections of microwave radiation by said microwave window are not more than about double the power of reflections at the minimum value.

35. A microwave window for transmitting microwave radiation comprising:

a solid body, the solid body including a first surface and a second surface spaced apart from each other in a first direction thereby defining a thickness of said solid body in said first direction;

a flange disposed at a periphery of said solid body such that a peripheral portion of the solid body extends a first length into said flange in a first direction and extends a second length in a second direction perpendicular to said first direction, wherein said first length, said second length and said thickness are selected such that the power of reflections of microwave radiation by said microwave window are no more than about ten times the power of reflections at the minimum value.

36. A microwave window as recited in claim 35, wherein said flange is adapted to mount said solid body onto a wall of a process chamber.

37. A microwave window as recited in claim 36, wherein said process chamber is configured to house a plasma.

38. A microwave window as recited in claim 37, wherein said first length and said second length are equal to an integer multiple of half of a wavelength of the microwave radiation and said thickness is selected such that microwave reflection from said window is minimized in the presence of said plasma.

39. A microwave window as recited in claim 35, wherein the power of the reflections of microwave radiation by said microwave window are not more than about five times the power of reflections at the minimum value.

40. A microwave window as recited in claim 35, wherein the power of the reflections of microwave radiation by said microwave window are not more than about double the power of reflections at the minimum value.

41. A plasma reactor comprising:

a process chamber adapted to house a plasma; and a microwave window assembly mounted on said process chamber, said microwave window comprising:

a solid body, the solid body including a first surface and a second surface spaced apart from each other in a first direction thereby defining a thickness of said solid body in said first direction;

a flange disposed at a periphery of said solid body such that a peripheral portion of the solid body extends a first length into said flange in a first direction and extends a second length in a second direction perpendicular to said first direction, said flange being adapted to mount said solid body onto a wall of said process chamber, wherein said first length, said second length and said thickness are selected such that the power of reflections of microwave radiation by said microwave window are no more than about ten times the power of reflections at the minimum value.

42. A plasma reactor as recited in claim 41, wherein said first length and said second length are equal to an integer multiple of half of a wavelength of the microwave radiation and said thickness is selected such that microwave reflection from said window is minimized in the presence of said plasma.

43. A plasma reactor as recited in claim 41, wherein the power of the reflections of microwave radiation by said microwave window are not more than about five times the power of reflections at the minimum value.

44. A plasma reactor as recited in claim 41, wherein the power of the reflections of microwave radiation by said microwave window are not more than about double the power of reflections at the minimum value.

45. A method for optimizing dimensions of a window for minimizing reflections of microwave radiation by the window, the window comprising: a solid body, the solid body including a first surface and a second surface spaced apart from each other in a first direction thereby defining a thickness of said solid body in said first direction; a flange disposed at a periphery of said solid body such that a peripheral portion of the solid body extends a first length into said flange in a first direction and extends a second length in a second direction perpendicular to said first direction, said window being mounted on a wall of a chamber housing a plasma, the method comprising:

running microwave simulations of microwave radiation transmission at various thicknesses of the solid body in the first direction, by taking into account absorption effects of the plasma; and determining the thickness of said solid body at which the power of reflections of the microwave radiation at a desired microwave frequency, are no more than about ten times the power of reflections at the minimum value.

46. A method for optimizing dimensions as recited in claim 45, wherein the power of the reflections of microwave radiation by said microwave window are not more than about five times the power of reflections at the minimum value.

47. A method for optimizing dimensions as recited in claim 45, wherein the power of the reflections of microwave radiation by said microwave window are not more than about double the power of reflections at the minimum value.

* * * * *